United States Patent [19]

Terekhov et al.

[11] 4,128,419

[45] Dec. 5, 1978

[54] NICKEL-BASE ALLOY

[76] Inventors: Kuzma I. Terekhov, Maly Pionersky pereulok, 5 kv. 44; Alexei T. Tumanov, Gruzinskaya ulitsa, 36, kv. 58; Alexandra P. Ozerova, Yartsevskaya ulitsa, 32/30, kv. 22, all of Moscow; Valentin V. Topilin, ulitsa Mira, 6, kv. 29, Elektrostal; Mikhail Y. Dzugutov, ulitsa Mira, 4, kv. 37, Elektrostal; Mara A. Ljubinskaya, ulitsa Mira, 4, kv. 60, Elektrostal; Gennady A. Pashchnik, ulitsa Sovetskaya, 9, kv. 22, Elektrostal; Alexandr S. Nikishov, ploschad Vosstaniya, 1, kv. 410, Moscow; Terenty I. Ustinov, ulitsa S. Lazo, 15, kv. 21, Kuibyshev, all of U.S.S.R.

[21] Appl. No.: 806,505

[22] Filed: Jun. 14, 1977

Related U.S. Application Data

[63] Continuation of Ser. No. 341,176, Mar. 14, 1973, abandoned.

[51] Int. Cl.[2] ..... C22C 19/05

[52] U.S. Cl. ..... 75/171; 148/32.5; 148/162

[58] Field of Search ..... 75/171, 170; 148/32, 148/32.5, 162

[56] References Cited

U.S. PATENT DOCUMENTS

| | | | |
|---|---|---|---|
| 2,104,836 | 1/1938 | Hessenbruch | 75/171 |
| 2,570,193 | 10/1951 | Bieber et al. | 75/171 |
| 3,744,996 | 7/1973 | Shaw et al. | 75/171 |

*Primary Examiner*—R. Dean

*Attorney, Agent, or Firm*—Haseltine, Lake & Waters

[57] ABSTRACT

The alloy contains in wt.%: 13–15 of chromium, 2.8–3.5 of molybdenum, 1.4–1.9 of aluminum, 2.3–3.0 of titanium, 1.8–2.4 of niobium, 0.001–0.05 of boron, 0.001–0.005 of cerium, 0.001–0.01 of lanthanum, 0.001–0.1 of magnesium, no more than 0.08 of carbon, 0.5–2.0 of iron, the rest being nickel.

2 Claims, No Drawings

NICKEL-BASE ALLOY

This is a continuation of U.S. application Ser. No. 341,176, filed Mar. 14, 1973, abandoned.

The present invention relates to non-ferrous metallurgy and, in particular, to the development of high-temperature workable nickel-base alloys for parts operating under high temperatures and stresses.

In the USSR, one of the best known and most commonly used high-temperature alloys for temperatures of up to 750° is the nickel-base alloy of the grade E1437BU whose wt.% composition is as follows: chromium, 19–22%; titanium, 2.5–2.9%; aluminum, 0.6–1.0%; iron, 1.0%; silicon, 0.5%; manganese, 0.4%; cerium, 0.01%; boron, 0.01%; carbon, 0.08%; the rest being nickel. Said alloy possesses the following properties: ultimate strength, 100 kg/mm$^2$; yield limit, 68 kg/mm$^2$; elongation, 13%; impact strength, 3 kgm/cm$^2$. Its heat resistance, under a temperature of 650° and a stress of 65 kg/mm$^2$ amounts to 30 hours and under a temperature of 750° and a stress of 35 kg/mm$^2$, to 50 hours.

However, with its relatively low heat resistance and short-term strength, said alloy cannot meet long-range requirements of designers as regards the manufacturing of parts of jet engines.

Also well-known is the nickel-base foundry alloy of the INKO 713C grade whose wt.% composition is as follows: chromium, 11–14%; molybdenum, 3.5–5.5%; niobium, 1.0–3.0%; aluminum, 5.5–6.5%; titanium, 0.25–1.25%; boron, 0.005–0.02%; zirconium, 0.05–0.2%; carbon, no more than 0.1%; the rest being nickel.

A high aluminum content in this alloy rules out its deformation under a hammer or a press, hence, this alloy is meant for casting smaller parts, such as blades, cast rotors, etc. Besides, the above-indicated alloy has inferior mechanical properties: ultimate strength, 88 kg/mm$^2$; yield limit, 76 kg/mm$^2$; elongation, 1.5–2%; impact strength, 2 kgm/cm$^2$.

The known heat-resistant high nickel-base alloys meant for heavy duty parts of a hot unit of a turbine operating under temperatures of up to 800°, as a rule, are marked by a high content of critical and expensive elements, such as cobalt and tungsten. The latter has a great specific weight (19.2 g/cm$^2$) which accounts for a greater weight of parts.

An object of the present invention is to provide a nickel-base alloy with heat resistance and mechanical properties equal to or surpassing those of cobalt-base alloys.

Another object of the present invention is to provide an alloy with high technological plasticity to ensure the manufacturing of parts with a homogeneous fine-grain structure both under a press and under a hammer.

In accordance with the foregoing and other objects proposed herein is a nickel-base alloy containing chromium, molybdenum, aluminum, titanium, niobium, boron and carbon, which, according to the invention, also contains lanthanum, cerium, magnesium and iron in the following wt.% ratio: chromium, 13–15; molybdenum, 2.8–3.5; aluminum, 1.4–1.9; titanium, 2.3–3.0; niobium, 1.8–2.4; boron, 0.001–0.05; cerium, 0.001–0.005; lanthanum, 0.001–0.01; magnesium, 0.001–0.1; carbon, no more than 0.08; iron, 0.5–2.0; the rest being nickel.

The novel alloy is economical in that it is based on non-critical and comparatively cheap elements, such as niobium, titanium, aluminum, molybdenum and chromium and contains no expensive critical elements, such as cobalt, tungsten, tantalum, etc., which are found in known alloys.

Naturally, the introduction into the alloy of such effective elements as niobium and molybdenum makes its composition more complex, yet at the same time it accounts for an increased thermal stability of the alloy's base. Besides, niobium, as well as titanium and aluminum, enters into the composition of the basic reinforcing $\gamma'$-phase and forms heat-resistant carbides NbC which contribute to grain refining and the formation of a homogeneous and uniform structure of the alloy. The introduction of magnesium improves the alloy's technological plasticity.

Thus, the rationally chosen ratio of the alloy elements ensures a high and uniform level of the alloy's short-term and long-term strength, plasticity and thermal stability, i.e. of properties which are of vital importance for a reliable prolonged operation of the most essential and heavy duty parts of jet engines.

The novel alloy is technologically easy to produce and readily yields to working both under a press and under a hammer, which makes it possible to fabricate parts of different weights (from 100 to 650 kg) and of highly complicated shapes.

The alloy is intended for the manufacturing of dynamically heavy duty parts of a hot unit of a turbine and compressor of jet engines with an extended service life of up to 20,000 hours and more operating under high temperatures and pressures.

The complex of the basic alloy elements: titanium, aluminum and niobium, which form the reinforcing $\gamma'$-phase makes for the alloy's high workability.

Comparison data on the mechanical properties and heat resistance of the novel and those of the known alloys are listed in Table 1.

The invention will now be explained with reference to examples of specific embodiments thereof.

Table 1

| | Mechanical properties | | | | Heat resistance | | | | | |
|---|---|---|---|---|---|---|---|---|---|---|
| | | | | | 650° | | | 750° | | |
| | Ultimate strength kg/mm$^2$ | Yield limit kg/mm$^2$ | Relative elongation % | Impact viscosity kg/mm$^2$ | stress kg/mm$^2$ | stability, hrs | relative elongation % | stress kg/mm$^2$ | stability, hrs | relative elongation % |
| Alloy of the invention | 120 | 75 | 16 | 5 | 72<br>74 | 100<br>51 | 6–8 | 40<br>42 | 100<br>50 | 8–10 |
| E1437BU | 100 | 68 | 13 | 3 | 65 | 30 | 3–4 | 30<br>35 | 100<br>50 | 3–4 |
| INKO 713C | 88 | 76 | 8 | 2 | 70 | 100 | 2–3 | 56 | 100 | 1.5 |

EXAMPLE 1

The alloy had the following wt.% composition: 0.04 of carbon, 13 of chromium, 1.5 of aluminum, 2.4 of titanium, 2.8 of molybdenum, 1.9 of niobium, 0.001 of lanthanum, 0.001 of magnesium, 0.005 of cerium, 0.005 of boron and 1.0 of iron, the rest being nickel.

Said alloy was subjected to thermal treatment which consisted in elevated temperature hardening at a temperature of 1100° C. during 8 hours with subsequent air cooling.

This was followed by air hardening, after the alloy had been aged at 1000° C. during 4 hours. After that, the alloy was subjected to ageing at a temperature of 775° C. during 16 hours, with subsequent air cooling, and then, to ageing at a temperature of 700° C. during 16 hours, also with subsequent air cooling.

After said thermal treatment, the proposed alloy had the following properties:

ultimate strength, 120 kg/mm$^2$;
yield limit, 75 kg/mm$^2$;
relative elongation, 20%;
impact strength, 5 kg/mm$^2$;
100-hour heat resistance at 750° and under a stress of 40 kg/mm$^2$, and at 650°, under a stress of 72 kg/mm$^2$.

EXAMPLE 2

The alloy had the following wt.% composition: 0.07 of carbon, 15 of chromium, 1.8 of aluminum, 2.6 of titanium, 2.2 of niobium, 3.2 of molybdenum, 0.01 of lanthanum, 0.005 of cerium, 0.005 of boron, the rest being nickel.

Said alloy was subjected to thermal treatment consisting in hardening at a temperature of 1100° C. during 8 hours, with subsequent air cooling.

This was followed by air hardening, after the alloy had been aged at 1000° C. during 4 hours.

After that, the alloy was subjected to ageing at a temperature of 775° C. during 16 hours, with subsequent air cooling, and then, ageing at a temperature of 700° C. during 16 hours, with subsequent air cooling.

After said thermal treatment, the proposed alloy had the following properties:

ultimate strength, 125–130 kg/mm$^2$;
yield limit, 80 kg/mm$^2$;
relative elongation, 16%;
impact strength, 4 kg/mm$^2$;
100-hour heat resistance at 750° C. and under a stress of 42 kg/mm$^2$, and at 650° C., under a stress of 74 kg/mm$^2$.

The reasonably alloyed high-temperature nickel-base alloy of the proposed composition possesses high mechanical properties and high resistance; it also displays good workability which makes for its wide use for manufacturing turbine disks, power rings and other parts operating at temperatures of up to 750° C. and under high rated stresses.

The rationally chosen ratio of the alloying elements in the novel alloy ensures a good combination of strength and plasticity characteristics which are of vital importance for a reliable prolonged operation of the most essential heavy-duty parts of jet engines.

What is claimed is:

1. A nickel-base alloy consisting essentially of in wt.%: 13–15 of chromium, 2.8–3.5 of molybdenum, 1.4–1.9 of aluminum, 2.3–3.0 of titanium. 1.8–2.4 niobium, 0.001–0.05 of boron, 0.001–0.005 of cerium, 0.001–0.01 of lanthanum, 0.001–0.1 of magnesium, no more than 0.08 of carbon, 0.5–2.0 of iron, the rest being nickel.

2. A nickel-base alloy according to claim 1 consisting essentially of in weight percent: 13 of chromium, 2.8 of molybdenum, 1.5 of aluminum, 2.4 of titanium, 1.9 of niobium, 0.005 of boron, 0.005 of cerium, 0.001 of lanthanum, 0.001 of magnesium, 0.04 of carbon, 1.0 of iron, the rest being nickel.

* * * * *